US010494900B2

(12) United States Patent
Cleven

(10) Patent No.: US 10,494,900 B2
(45) Date of Patent: Dec. 3, 2019

(54) SYSTEM FOR STIMULATING A WELL

(71) Applicant: COMITT WELL SOLUTIONS US HOLDING INC., Katy, TX (US)

(72) Inventor: Peter Kris Cleven, Grand-Barachois (CA)

(73) Assignee: COMITT WELL SOLUTIONS US HOLDING INC., Katy, TX (US)

( * ) Notice: Subject to any disclaimer, the term of this patent is extended or adjusted under 35 U.S.C. 154(b) by 11 days.

(21) Appl. No.: 15/888,473

(22) Filed: Feb. 5, 2018

(65) Prior Publication Data

US 2018/0163510 A1 Jun. 14, 2018

Related U.S. Application Data

(63) Continuation of application No. PCT/US2016/054147, filed on Sep. 28, 2016.

(30) Foreign Application Priority Data

Oct. 2, 2015 (NO) ..... 0151306

(51) Int. Cl.

| | |
|---|---|
| ***E21B 34/10*** | (2006.01) |
| ***E21B 43/25*** | (2006.01) |
| ***E21B 43/16*** | (2006.01) |
| ***E21B 37/08*** | (2006.01) |
| ***E21B 34/06*** | (2006.01) |
| ***E21B 34/14*** | (2006.01) |
| *E21B 43/26* | (2006.01) |
| *E21B 34/00* | (2006.01) |

(52) U.S. Cl.

CPC ..... *E21B 34/10* (2013.01); *E21B 34/063* (2013.01); *E21B 34/14* (2013.01); *E21B 37/08* (2013.01); *E21B 43/16* (2013.01); *E21B 43/25* (2013.01); *E21B 43/26* (2013.01); *E21B 2034/007* (2013.01)

(58) Field of Classification Search

CPC ..... E21B 34/103; E21B 43/25; E21B 34/063; E21B 43/16

See application file for complete search history.

(56) References Cited

U.S. PATENT DOCUMENTS

| | | | |
|---|---|---|---|
| 8,403,068 | B2 | 3/2013 | Robison |
| 8,776,885 | B2 | 7/2014 | Holderman |

(Continued)

FOREIGN PATENT DOCUMENTS

| | | |
|---|---|---|
| CA | 2883686 | 8/2015 |

*Primary Examiner* — Cathleen R Hutchins
(74) *Attorney, Agent, or Firm* — Pierson IP, PLLC

(57) ABSTRACT

A system (1) for stimulating a well with an annulus (3) formed by a string (2) and a wellbore (4), wherein the system (1) comprises a pressure activated injection assembly (200) configured to open at an activation pressure below an injection pressure and a mechanically operated sand control assembly (100) configured to flush the annulus (3) after injection. The system (1) comprises a pressure activated flushing device (500) mounted uphole from the injection assembly (200) and configured to open radial flush ports (501, 502) between the interior of string (2) and the annulus (3) at a flushing pressure above the injection pressure. An optional release mechanism for the pressure activated injection assembly (200) is also disclosed.

14 Claims, 3 Drawing Sheets

(56) References Cited

U.S. PATENT DOCUMENTS

| | | | | |
|---|---|---|---|---|
| 2011/0100643 | A1* | 5/2011 | Themig | E21B 34/102<br>166/373 |
| 2014/0069652 | A1 | 3/2014 | Gay et al. | |
| 2016/0298417 | A1* | 10/2016 | Styler | E21B 34/063 |

* cited by examiner

SYSTEM FOR STIMULATING A WELL

BACKGROUND

Field of the Invention

The present invention concerns a system for stimulating a well.

Prior and Related Art

As the term is used herein, a wellbore is a fully or partly cased borehole extending through layers in an underground geological structure, hereinafter a formation. A well is a borehole with equipment needed for its operation, e.g. for producing oil or gas from a reservoir, for producing geothermal energy or for injecting fluids for enhanced oil recovery or for storing $CO_2$. The well may be placed onshore or offshore, and the invention is neither limited to any particular industry nor to the purpose of the well.

A well may extend more or less horizontally. For ease of explanation, the terms "upstream" and "uphole" are used herein for the direction toward the surface regardless of the actual direction of a fluid flow or the inclination of the wellbore. Similarly, "downstream" and "downhole" refer to the opposite direction, i.e. away from the surface.

Stimulating or treating a well means to improve its performance, typically by improving the fluid flow between the formation and wellbore. As used herein, stimulating a well, "stimulation" for short, involves increasing an injection pressure to force some agent, e.g. acid or a propping agent, into the formation, and reduce the pressure when the agent is injected. Hydraulic fracturing of a production well for hydrocarbons, i,e, oil and/or gas, will be used as a non-limiting example in the following.

In the oil and gas industry, a "zone" includes a layer containing hydrocarbons. In the present example, a casing is perforated at the zones. The "target zone" is the zone to be stimulated.

Hydraulic fracturing is performed by pumping a liquid into the formation at a pressure sufficient to create fractures in the formation. When the fracture is open, a propping agent is added to the liquid. The propping agent remains in the fractures to keep them open when the pumping rate, and hence the pressure, decreases.

The break-down pressure, i.e. the pressure required to create fractures in the formation, depends on the compressive pressure in, and the strength of, the formation. Thus, the break-down pressure and its associated injection rate vary significantly between applications. In the present example, the fractures would ideally be wings extending into the target zone, and a layer of impermeable rock above the porous layer containing oil or gas would prevent the fractures from extending. However, fractures, faults etc. already present in the formation will usually cause a tree-like fracture structure in the zone. In addition, fractures in the layers adjacent to the layer comprising hydrocarbons may widen and cause leakages and loss to formation.

Even when water is not lost to the formation, hydraulic fracturing consumes a significant amount of water. According to Arthur, J. D., "A Comparative Analysis of Hydraulic Fracturing and Underground Injection", presented at the GWPC Water/Energy Symposium, Pittsburgh, Pa., Sep. 25-29, 2010, a water consumption of 1 000 to 20 000 bbl/day (119-2 400 $m^3$/day) is common for onshore wells in the US. To limit the water consumption, especially in arid areas, the water may be recycled on the surface.

At some point, a propping agent is added to the liquid and inserted into the fracture. The propping agent, e.g. sand or ceramic beads, remains in the fracture when the injection pressure drops, and thereby keeps the fractures open. Fracturing or other stimulation may be repeated several times during the lifetime of a well, so there is a general need to reduce the cost of re-fracturing as much as possible.

Specifically, if the cost of re-fracturing is too high, the well may be abandoned even if the reservoir is not depleted. Similarly, if low-cost re-fracturing was available, several abandoned production wells might become profitable. Similar considerations apply to production start of marginal fields, to stimulation other than hydraulic fracturing and to injection wells. Thus, there is a need to reduce the cost of stimulating and re-stimulating a well.

When assessing the profitability of stimulation or re-stimulation, at least the following potential problems and shortcomings should be considered and accounted for:

- any need for separate trips, i.e. inserting and retrieving a string once per target zone;
- cost and/or availability of water and/or recycling process water;
- high pressure injection at a target zone may force sand from the formation into the fractures and/or the wellbore at adjacent zones.

Our co-pending patent application U.S. Ser. No. 14/629,184 A1 discloses an injection assembly that solves or reduces some of the problems and shortcomings above. Specifically, the injection assembly comprises a string with an upstream packer and a downstream packer for isolating a target zone, and a normally closed injection valve between the packers. A normally open bottom valve at the very end of the string allows fluid circulation during run in, and closes when an injection rate exceeds a preset level. Water, possibly with soluble additives, is used for the circulation. The return water typically contains sand and other solid particles, which are relatively easy to remove. Inexpensive recycling reduces water consumption and cost of operation. After injection, the apparatus is reset such that it can be moved to a new target zone where the process is repeated. Thus, several zones can be stimulated in one trip, which saves time and reduces operational costs.

The packers in the injection assembly are called "zone isolation packers" in the following to avoid confusion with packers that may be present uphole from the injection assembly.

In some applications, sand and gravel from the formation enters the annulus between the string and inner wall of the wellbore. The produced sand enters the annulus during or after stimulation, e.g. at the target zone when the injection pressure drops after stimulation. During stimulation, a high injection pressure may leak to regions of the wellbore away from the target zone. If the wellbore is open hole, i.e. uncased, or the casing has perforations in this region, produced sand may enter the annulus above the packers isolating the target zone during stimulation. Regardless of cause or path, produced sand in the annulus may prevent the string and injection assembly from moving to the next target zone or to the surface.

This is partly solved by a system and method for sand control presented in Norwegian patent application no. 20150652, assigned to the present assignee. This system comprises a pressure activated section with a pressure activated sliding sleeve placed between pressure activated uphole and downhole packers. This pressure activated section activates at a bore pressure at or below the injection pressure. The system comprises an additional mechanically activated section comprising a mechanically activated packer mounted uphole from a mechanically operated valve, which in turn is mounted uphole from the pressure activated section. An anchor is provided to fix a downhole part of the string to the wellbore, such that an upper part of the string can be manipulated from the surface in a series of down-weights, pull-ups and right-hand-turns, thereby operating the mechanically operated section. The idea is to seal off the wellbore after injection, and then flush sand and debris from the annulus by means of the mechanically activated valve. This flushing can be performed after every injection or just when the string gets stuck or any combination of these.

There is, however, a risk that the upper part of the string gets stuck in sand and debris after injection. If it does, the mechanically operated packer and valve cannot be manipulated properly from the surface, so the sand control system of NO 20150652 A1 is unable to flush the sand and debris from the annulus.

An objective of the present invention is to improve the injection assembly described above, in particular to reduce the effects of produced sand in the annulus around the string used for stimulating a target zone.

SUMMARY OF THE INVENTION

This is achieved by a system according to claim 1.

In a first aspect, the invention provides a system for stimulating a well with an annulus formed by a string and a wellbore, wherein the system comprises a pressure activated injection assembly configured to open at an activation pressure below an injection pressure and a mechanically operated sand control assembly configured to flush the annulus after injection. The system is distinguished by a pressure activated flushing device mounted uphole from the injection assembly and configured to open radial flush ports between the interior of string and the annulus at a flushing pressure above the injection pressure.

When the upper part of the string is stuck such that the mechanically operated sand control assembly does not work, the pressure within the string can be increased to the flushing pressure in order to flush the annulus by means of the flushing device. As the flushing pressure is greater than the activation pressure for the injection assembly, isolating injection packers will set and the injection valve will open during the pressure increase to the flushing pressure.

In some embodiments, the flushing device may comprise a burst disc designed to rupture at the flushing pressure. These embodiments are suitable when the vast majority of sand-packing incidents are expected to be handled by the sand control assembly, i.e. when withdrawing the string to replace a burst disc would be rare. More precisely, embodiments with a burst disc would be preferred when their added cost discounted to present, i.e. their net present value, is less than the net present value of more expensive devices.

In some embodiments, the flushing device comprises a sliding sleeve with a net piston area configured to shift the sliding sleeve past radial ports in an associated valve when exposed to the bore pressure. The associated valve is a normally closed sliding sleeve valve of known design, i.e. any suitable valve where the bore pressure exerted on a net piston area shifts the sliding sleeve to open for a fluid flow from the interior of the string.

In principle, the sliding sleeve may be arranged within a chamber closed by a burst disc. The burst disc is designed to rupture at the flushing pressure, and the net piston area just has to be sufficiently large to open the associated valve when the burst disc ruptures. However, in most applications, a burst disc would suffice to open the ports, so the sliding sleeve would probably be superfluous.

Thus, in preferred embodiments of flushing devices with a sliding sleeve, the net piston area is exposed to the bore pressure. It is understood that a filter would preferably be provided to prevent particles in the bore fluid from entering the region with the sliding sleeve.

The sliding sleeve may initially be retained by a shear element designed to break when the net piston area is exposed to the flushing pressure. The shear element may be one or more shear pins, a breakable washer or other element(s) known in the art. Breaking the shear element is irreversible, so the entire assembly would have to be retrieved after use of the flushing device.

Rather than a shear element, still further preferred embodiments with a sliding sleeve comprise a spring configured to oppose the pressure force exerted on the net piston area and, when the sliding sleeve is displaced to expose the radially directed ports, provide a spring force equal to the flushing pressure times the net piston area. These embodiments return to their initial state after use, so there is no need to retrieve the entire assembly in order to replace parts, e.g. burst discs or shear pins. Accordingly, a spring loaded sliding sleeve might be preferred over less expensive burst discs or shear pins in applications with a significant risk for sand intrusion in the region with the sand control assembly. Adapting the spring stiffness, spring expansion and net piston area to open the associated valve at the flushing pressure and to start displacing the sliding sleeve at a suitable less pressure, are design issues left to the skilled person.

In some embodiments, the flushing device comprises a nozzle directed axially and/or tangentially relative to the string. The purpose is to direct jets along the string to release the mechanical sand control assembly regardless of the state further downhole. For example, the jets may be aimed to push part of the sand, in particular sand close to the string, temporarily uphole. As noted isolation packers may be set and the injection valve may be open as the flushing pressure is greater than their activation pressure. A packer may block or inhibit a flow back to the formation. Furthermore, the injection pressure applied through the open injection valve caused the sand block in the first place. It is unlikely that a higher flushing pressure applied through an open injection valve would help.

In some embodiments, the system further comprises a release mechanism configured to release the injection assembly at an intermediate pressure between the injection pressure and the flushing pressure. Thereby, the sand plug blocking the annulus can be pushed back toward the formation. The release mechanism can be of any known type, for example one comprising a piezoelectric pressure sensor, an electronic controller and an actuator controlled by the controller to deactivate the injection assembly at the predetermined pressure.

In a preferred embodiment, the release mechanism comprises an inner sleeve with an inner piston area exposed to a central bore, a radial release opening and an outer piston area. The release mechanism further comprises a return spring opposing a pressure force exerted on the inner piston area and a release sleeve arranged between a fixed housing and the inner sleeve. The inner sleeve is axially movable between an idle position and a release position in which the radial release opening opens an inner fluid connection from the central bore to the outer piston area. The release sleeve is axially movable between a normal operations position in which the release sleeve closes the inner fluid connection and opens an outer fluid connection from the exterior of the housing to the outer piston area and an inactivation position in which the release sleeve closes the outer fluid connection and opens the inner fluid connection. The release mechanism is configured such that the inner sleeve reaches the release position when the intermediate pressure is exerted on the inner piston area, and such that the release sleeve shifts from the normal operations position to the inactivation position when the inner sleeve shifts from the release position to the idle position.

When the inner sleeve shifts to the release position, the outer piston area is exposed to the bore pressure. This reduces the net pressure force on the inner sleeve such that the return spring shifts the inner sleeve back to the idle position. At about the same time, the release sleeve from a normal operation position where the outer piston area is exposed to ambient pressure to an inactivation position where the outer piston area is exposed to the bore pressure. The release sleeve may be shifted by means of a piston area that becomes exposed to the bore pressure when the inner sleeve opens the inner fluid connection and/or pulled along by latches, e.g. radially biased lugs engaging suitable grooves, provided between the inner sleeve and the release sleeve.

The release mechanism may be configured to return an isolation packer to an unset run-in state when the inner sleeve returns to the idle position. This means that the inner sleeve, the housing and the return spring are elements of the isolation packer, and that the difference between the inner and outer piston area is sufficiently small to allow the return spring to overcome any sticking and elastic resistance from packer elements in addition to the residual net pressure force working against the spring force.

The release mechanism may alternatively be configured to return a sliding sleeve injection valve to a closed run-in state when the inner sleeve returns to the idle position. This means that the inner sleeve is shifted to expose or cover radial ports through the housing wall in the idle and an operational position, respectively. The difference between the inner and outer piston area should be sufficiently small to allow the return spring to properly close the injection valve.

In preferred embodiments, the inner sleeve has an active position range corresponding to bore pressures ranging from the activation pressure to the injection pressure. During normal operation, the inner sleeve is maximally displaced to a position corresponding to the injection pressure exerted on the inner piston area. This position should be at a safe distance from the release position, so that the inner sleeve does not inadvertently reach the release position if the injection pressure is exceeded during normal operation.

In embodiments with an active position range, the release sleeve is preferably retained in the normal operation position within the fixed housing by a retainer. The release sleeve will not shift before an axial force provided by the retainer is overcome. This permits a variation in bore pressure without an associated risk for moving the release sleeve and thereby activating the release mechanism inadvertently.

In preferred embodiments of the release mechanism, the outer piston area is configured to move axially in a longitudinal conduit through a cylindrical wall of the release sleeve. This allow the longitudinal conduit to be a part of the outer fluid connection between a radial port in the housing wall and the outer piston area, and thereby saves space.

In preferred embodiments with a longitudinal conduit, the longitudinal conduit has an end that aligns with the release opening when the inner sleeve is in the release position. In these embodiments, the longitudinal conduit doubles as part of the inner and outer fluid connections.

Further features and benefits of the invention will appear from the following detailed description.

BRIEF DESCRIPTION OF THE DRAWINGS

The invention will be described by means of examples and with reference to the accompanying drawings, in which.

DETAILED DESCRIPTION OF PREFERRED EMBODIMENTS

The drawings are schematic and intended to illustrate principles of the invention. They are not necessarily to scale, and numerous details known to the skilled person are omitted for clarity.

Figure 1:
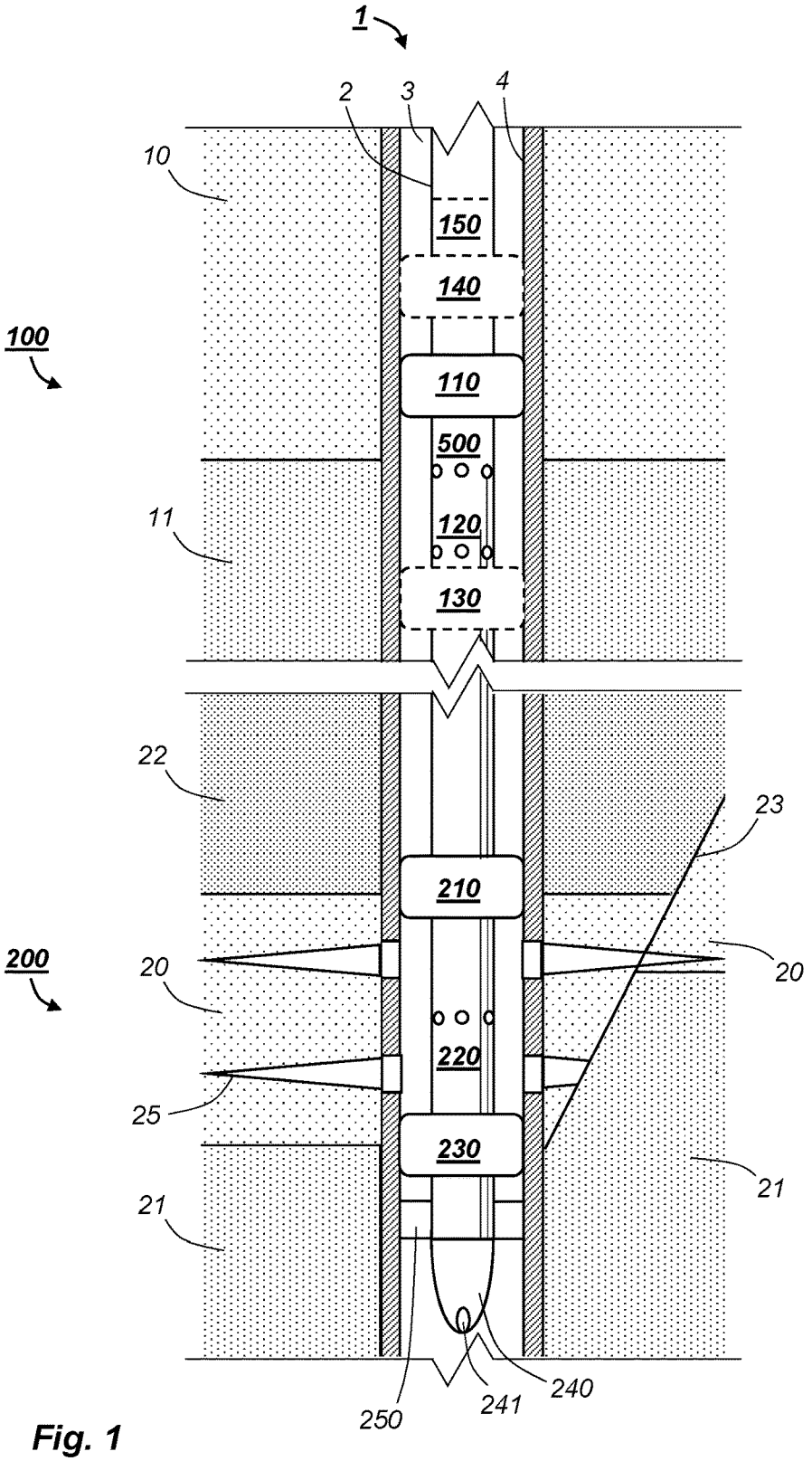
FIG. 1 illustrates a system according to the invention inserted into a wellbore.

FIG. 1 illustrates main components of a system 1 according to the invention. A hollow string 2 running from the surface connects all components in the system 1. In some applications, the string 2 may be coiled tubing. In this example, however, the string 2 comprises standard tubular joints connected by threaded pins and boxes.

In FIG. 1, the string 2 is inserted into a wellbore, i.e. a borehole with a steel casing 4 cemented to a surrounding formation along all or part of the borehole. The casing 4 extends through layers 10, 11, 22, 20 and 21 of the formation. Each layer comprises a different type of rock. The target zone 20 is the zone currently being treated or stimulated. Any zone comprises a porous rock type, e.g. sand stone, shale or limestone, with hydrocarbons. As the rock is porous, it is easily broken down to sand and gravel during stimulation and re-stimulation.

A denser rock type is required above any zone to prevent the hydrocarbons in the zone from migrating to the surface. This is illustrated by layer 22 above the target zone 20.

The casing 4 is perforated at zone 20 to permit a fluid flow from the zone 20 into a production string during production, or from the string 2 to the zone 20 during stimulation, e.g. hydraulic fracturing to create fractures 25. The fractures 25 are shown as idealized wings extending from the perforations in the casing 4. In reality, they may form a tree-like structure and/or contain sand and gravel from the formation.

On the right hand side of FIG. 1, the layers 20 and 21 are shifted upward along a fault plane 23. Faults 23 and fractures caused by shifts in the Earth's crust and manmade fractures 25 may provide a fluid path such that hydraulic fracturing of zone 20 may cause sand to enter the annulus 3 somewhere upstream from the target zone 20.

The system 1 comprises a sand control assembly 100 and an injection assembly 200. The purpose of the sand control assembly 100 is to remove produced sand and gravel from the annulus 3, such that the system 1 may move on to another target zone or to the surface. As a formation may produce sand somewhere upstream from the target zone 20 as explained above, and as the casing 4 may have holes through which the produced sand may enter the annulus 3, the distance between the assemblies 100 and 200 must be adapted to the application at hand. However, a distance in the range 10-30 m (~30-100 ft) is believed to be suitable in most cases.

For ease of description, the term "mechanically operated" is used herein for devices operated by moving the string 2, as opposed to "pressure activated" devices, which are operated by changing a bore pressure within the string 2. As a rule, the sand control assembly 100 is mechanically operated and will not be affected by the borehole pressure within the string 2. Similarly, the injection assembly 200 is pressure activated, and will not be affected by uphole motions of the string 2. However, the anchor 250 at the injection assembly 200 may be set and unset by pushing and pulling string 2, and optional packers 130, 140 at the sand control assembly 100 may seal by bore pressure.

The sand control assembly 100 comprises an optional mechanically operated sand control element 110 and a mechanically operated sand control valve 120. The purpose of the sand control valve 120 is to flush sand from the annulus 3, for example after a fracturing operation. This requires a certain flushing pressure in the annulus 3 downstream from the sand control element 110, and the sand control element 110, if present, should be designed to withstand the pressure difference caused by this flushing pressure. As it would be expensive and/or impractical to design the sand control element 150 for any thinkable pressure difference or condition in the wellbore during and after stimulation, the sand control assembly 100 may include one or more optional packers 130, 140 to handle such extraordinary conditions.

In some circumstances, it would be desirable to clear the annulus 3 during normal operation, e.g. through the mechanical sand control assembly 100. The associated washing pressure is substantially lower than the flushing pressure in the present application. For example, the washing pressure might be 0.5-1.5 times the injection pressure, whereas the flushing pressure, as the term is used herein, might be 2-5 times the injection pressure. In the following three examples, the injection is done.

In a first example, there is no significant risk for produced sand in the region around the sand control assembly 100. Then, the sand control element 110 may be superfluous, and there is no need for additional packers 130, 140.

In a second example, a high injection pressure and a leaky formation injects significant amount of sand into the annulus 3 during stimulation. If the sand control element 110 is set after the stimulation, the sand may prevent element 110 from sealing against the casing 4. In this case, it would be practical to arrange a pressure activated packer 130, preferably of the same type as the pressure activated packers 210, 230 in the injection assembly 200, downstream from the sand control valve 120. Alternatively, it is possible to set the sand control element 110 before stimulation and open the sand control element after stimulation. This would require separate operating sequences for the element 110 and valve 120, and thus make the design of the sand control assembly 100 more complex.

In a third example, there is a risk that the element of a packer 130 downstream from the sand control valve 120 seals against the casing 4 after stimulation, e.g. because there may be a remaining pressure over a pressure activated packer 130. This would prevent flushing by an upstream valve. In this case, a pressure activated packer 140 uphole from the sand control valve might be a better idea.

The three examples above illustrate that a practical design of the sand control assembly 100 must be left to a skilled person knowing the application at hand.

In all embodiments, the sand control element 110 is retracted during run-in to allow circulation through the annulus 3 as further described below. The sand control valve 120 is normally closed. i.e. closed during run-in.

An optional check valve 150 may be provided within the string 2 to ensure that liquid and/or sand is not conveyed toward the surface through the string 2, in particular if the bore pressure may become less than the pressure in annulus 3, e.g. shortly after a high-pressure injection.

The injection assembly 200 in FIG. 1 comprises two zone isolation packers 210, 230, one packer 210 upstream from the target zone 20, and one 230 downstream from the target zone 20. The assembly works in the manner described with reference to U.S. Ser. No. 14/629,184 A1 in the introduction. In addition, the injection assembly 200 may comprise a complementary valve (not shown) as disclosed in our patent application NO20150459A1. The complementary valve is designed to remove the pressure difference over the injection assembly 200 after a predetermined time delay, usually a few minutes. Thus the packers 210, 230 are set when the bore pressure exceeds a predetermined activation pressure and unset when the bore pressure drops below the activation pressure, optionally after a time-delay. Similarly, the injection valve 220 is open at bore pressures above the activation pressure and closes, possibly after a time-delay, when the bore pressure drops below the activation pressure.

During run-in, i.e. when the system 1 moves along the wellbore, a limited flow of liquid exits the string 2 through an opening 241 and returns to the surface through the annulus 3 between the string 2 and the casing 4. The liquid is typically water, possibly with additives to prevent scaling, corrosion etc., but without propping agent. The flowrate is relatively low, for example about 600 l/h (~5 bbl/h) or 10-20% of the injection flow associated with the break down pressure.

In the state shown in FIG. 1, the bottom valve 240 is closed, packers 210 and 230 are set to isolate zone 20, and fluid containing a propping agent is injected by means of the injection valve 220. As noted in the introduction, the injection rate associated with the break down pressure vary widely between applications. Values above 1 l/s (30 bbl/h) are common.

As shown in FIG. 1, an anchor 250 engages the casing 4 and prevents axial and rotational motion of the injection assembly 200. Thus, the anchor 250 provide the reactive forces required for operating the sand control assembly 100 by pushing, pulling and turning the string 2 from the surface. In the following, the different string motions are called "down-weight", "pull-up" and "right-hand turn" in accordance with common usage. Specifically, the string 2 above the sand control assembly 100 is moved uphole, downhole or in right-hand turns relative to the anchor 250 and the casing 4. Left hand turns are not permitted within the wellbore, as they would loosen the connecting threads in the system 1 and/or string 2. At the surface, i.e. out of the wellbore, left hand turns are required to break up the string 2.

The anchor 250 is an off-the-shelf component, and either mechanical set or hydraulic. It must be set in the casing 4 for operation of the sand control assembly 100, and is preferably locked during run-in.

Thus, a suitable mechanical set anchor 250 has an element, e.g. a spring loaded dog, that provides sufficient friction with the casing 4 to permit an unlock combination.

Such anchors typically comprise a J-slot or the like to provide a desired sequence of operation. In the present example, pull-up, right-hand turn unlocks the anchor 150. Once unlocked, the anchor 250 is set by applying down-weight. It remains set as long as the down-weight is maintained, and is unset and locked when the down-weight is removed, e.g. due to a pull-up.

Alternatively, a hydraulic anchor 250 may be employed. This may be set by the increasing bore pressure, for example at the activation pressure that sets the isolation packers and opens the injection valve 220.

In particular, the anchor 250 can be moved downstream in casing 4 without setting, as it must be unlocked by a pull-up and right-hand turn before setting is possible. When the anchor 200 moves upstream, it most likely unlocks due to pull and right-hand turns, but it will not set unless a down-weight is applied.

The mechanically operated sand control assembly 100 described above is essentially activated by down-weights and deactivated by pull-up. However, the downstream part of string 2 must be immovable with respect to the casing 4 before a push, pull or turn of the string 2 affects any device 110-150 described above. Normally, the anchor 250 prevents axial and rotational motion of the downstream end. The circulation through the bottom valve 150 with return path through the annulus 3 minimizes the risk for stopping the downstream end in produced sand or debris. Thus, the sand control assembly 100 may move upstream and downstream within casing 4, as long as the anchor 250 remains unset and the circulation through the bottom valve 150 is maintained.

From the description above, it should be understood that alternative sequences or combinations of down-weights, pull-ups and right-hand turns may be employed to operate the sand control assembly 100 and the anchor 250. For example, a pull-up or a down-weight may be combined with a right-hand turn without affecting the function of a device, e.g. setting or unsetting the sand control element 110 or operating the sand control valve 120. In addition, the function caused by down-weight and pull-ups may be reversed throughout without affecting the functions of the system. For example, the anchor 250 might unlock by down-weight plus right-hand turn and set by pull-up. In this case, the sand control assembly 100 would be adapted to activate at pull-ups and deactivate at down-weights.

Either way, the operation sequence of the anchor 250 must permit axial or rotational motion during run-ins, and the operation sequence of the sand control assembly 100 must be adapted to the chosen anchor 250. Of course, the dimensions and other specifications of the anchor 250 must also match those required by the sand control assembly 100.

Assume in the following that a zone has been treated, e.g. by hydraulic fracturing, and the bore pressure has been lowered when it is discovered that the string 2 is stuck, i.e. that the sequence of string motions for controlling the sand control assembly 100 cannot be made. Then, the sand control packer 110 is not set, and the sand control valve 120 does not open to flush sand and debris from the annulus 3.

For this, a pressure activated flushing device 500 is arranged uphole from the injection assembly 200, e.g. in the region of the mechanical sand control assembly 100. The flushing device 500 is intended to flush the annulus 3, at least in the section with the mechanical sand control assembly 100. The pressure operated flushing device 500 should be designed to open at a bore pressure, hereinafter denoted the flushing pressure, substantially higher than the injection pressure, so that the flushing device 500 does not open inadvertently during injection, for example during hydraulic fracturing.

Figure 2:
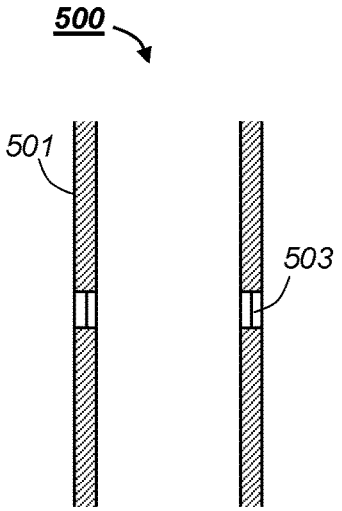
FIG. 2 illustrates a flushing device with a burst disc.

FIG. 2 illustrates an embodiment wherein the flushing device 500 comprises burst discs 503 arranged in ports in the wall of a housing 501. The housing 501 is configured to be included in string 2, e.g. by standard box and pin threading. The burst discs 503 are designed to rupture or break at a flushing pressure substantially greater than the injection pressure, for example twice or more the injection pressure.

Figure 3:
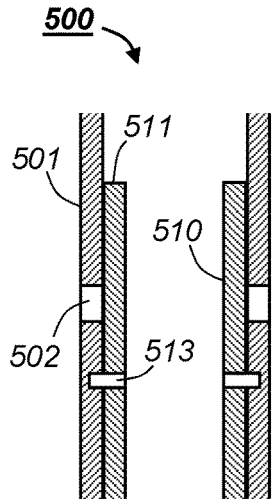
FIG. 3 illustrates a flushing device with a sliding sleeve retained by a shear element.

FIG. 3 illustrates another embodiment of the flushing device 500 comprising a sliding sleeve 510 with a net piston area 511 exposed to the bore pressure within string 2. During injection, i.e. normal operation, shear element 513, e.g. shear pins or a shear washer, retain the sliding sleeve 510 such that it covers ports 502. The shear element 513 is configured to break at a force equal to the net piston area 511 times the flushing pressure. Thus, he sliding sleeve 510 shifts axially to expose the ports 502 when the bore pressure reaches the level termed flushing pressure herein.

The term "net piston area" is used for convenience, and should be construed as the difference between an inner piston area exposed to the bore pressure and an outer piston area exposed to the pressure around the housing 501. During stimulation, the inner piston area will be exposed to injection fluids, which may contain particles. Scaling, i.e. deposits of mainly calcium carbonate and wax, will probably not be a problem. To prevent particles from reducing the net piston area 511, a filter is preferably located between the net piston area 511 and the central bore running through the string 2 and housing 501. Another filter is preferably located in the wall of housing 501. This is further explained with reference to FIGS. 6*a-d*.

Figure 4:
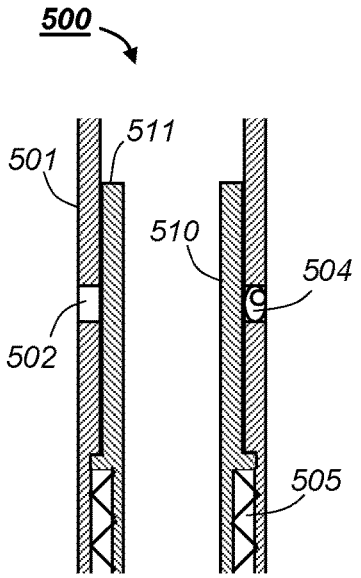
FIG. 4 illustrates a flushing device with a spring loaded sliding sleeve.

FIG. 4 illustrates a sliding sleeve 510 with a net piston area 511 as above. The net pressure force exerted on the net piston area 511 is opposed by a spring force from a return spring 505. As well known in the art, the spring force equals a spring stiffness times the compression or extension of the spring (Hooke's law). Thus, adapting the net piston area 511, selecting a spring 505 with a suitable stiffness and providing a pre-compression to cause the sleeve 510 to shift at the intermediate pressure is a design issue left to the skilled person. A main benefit of the embodiment in FIG. 4 is that the spring 505 returns the sliding sleeve to the closing position shown in FIG. 4 after use. Thus, the embodiment in FIG. 4 may proceed with the stimulation immediately after use, whereas the embodiments in FIGS. 2 and 3 must be retrieved to the surface to replace the burst disc 503 or shear element 513.

FIG. 4 also illustrate a radial port provided with a nozzle 504 to illustrate that the ports 502 can have an outlet at any angle to the axis of rotation symmetry of the housing 501, and hence with the string 2, and/or be provided with nozzles. If, for example, jets from the ports 502 are directed axially uphole, they may help moving sand temporarily uphole from the sand control assembly 100. Then, it does not necessarily matter if the uphole zone isolation packer 210 is fully or partly set, or if the sand pack downstream from the flushing device 500 requires the full power of the mechanical sand control assembly 100. In addition or alternatively, the nozzle 504 could be directed tangentially, i.e. in the circumferential direction, to concentrate the power from the flushing pressure to the region immediately around string 2 rather than directing jets radially toward the inner wall of the wellbore 4.

When the bore pressure increases toward the flushing pressure that activates the flushing device, the isolation packers 210 and 230 will set and the injection valve 220 will open at the activation pressure, i.e. somewhat below the injection pressure. If the uphole packer 210 remains set, the sand cannot be flushed back to the formation. This may not be a problem if the flushing device is configured just to loosen the string 2 sufficiently to operate the sand control assembly 100. However, currently preferred embodiments include a release mechanism that unset the isolation packers 210, 230 and closes the injection valve 220 during flushing.

Figure 5:
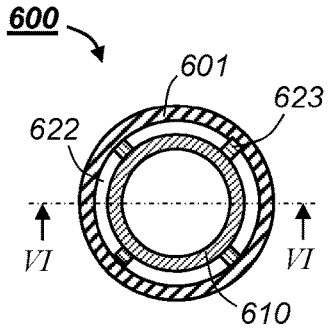
FIG. 5 is a cross section of a release mechanism taken along plane V-V in FIG. 6*b*
Figure 6A:
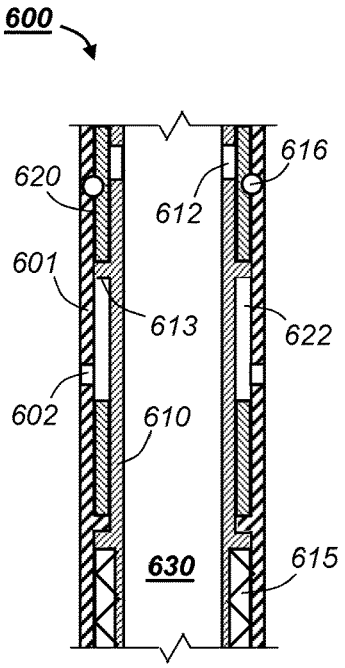
FIGS. 6*a-d* illustrate different states of the release mechanism in FIG. 5.
Figure 6B:
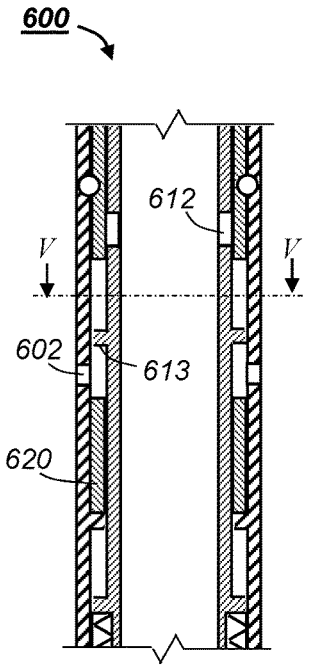

FIG. 5 is a cross section of an optional release mechanism taken along the plane V-V in FIG. 6*b*. It is noted that the packers 210, 230 are set and unset, and that the injection valve 220 is opened and closed, by shifting different spring loaded sleeves. The release mechanism 600 is a generic mechanism for a spring loaded inner sleeve 610, that may, for example, represent the shifting sleeve within a packer 210, 230 or an injection valve 220.

More particularly, the release mechanism 600 comprises a housing 601 configured to be included in the string 2, e.g. by standard threaded pins and boxes. Thus, in use, the housing is fixed with respect to the string 2. For ease of explanation, axial motion is described without specifying "relative to the fixed housing" in every instance.

The inner sleeve 610 is concentric with and axially movable within the housing 601. A release sleeve 620 (FIG. 6*a-d*) is mounted concentric with the housing 601 and the inner sleeve 610. As best seen in FIGS. 6*a-d*, the release sleeve 620 comprises axially extending conduits 622 through part of its cylinder wall. Axially extending ribs 623 connect the parts of release sleeve 620 on either end of the conduits 622. The release sleeve 620 is axially movable relative to the housing 601 and relative to the inner sleeve 610.

FIGS. 6*a-d* are longitudinal cross sections of the release mechanism 600 taken along the plane VI-VI in FIG. 5.

FIG. 6*a* illustrates an idle state, in which the inner sleeve 610 is in an idle position and the release sleeve is in a normal operations position. The idle position corresponds to the run-in state, where the isolation packers 210, 230 are unset and the injection valve 220 is closed. The inner sleeve 610 has a radial opening 612 though its cylinder wall. During normal operation, e.g. in the idle state in FIG. 6*a*, the opening(s) 612 is/are covered by the release sleeve 620. Seals, e.g. O-rings (not shown), may be provided uphole and downhole from the radial opening 612. The inner sleeve 610 further comprises an outer piston area 613 exposed to the ambient pressure through ports 602 in the wall of housing 601 and the conduits 622. Pressure exerted on the outer piston area 613 causes a pressure force in the same direction as the spring force from a return spring 615 acting on the inner sleeve 610. In general, the release sleeve 620 provides an outer fluid connection through one or more longitudinal conduits 622 from the port(s) 602 to the outer piston area 613. In the idle state shown in FIG. 6*a*, the release sleeve 620 also block an inner fluid connection from the central bore 630 to the outer piston area 613.

The release sleeve 620 is retained in the housing 601 by a retainer. In the present example, the retainer comprises is a radially biased ball 616 received in a groove 617 (FIG. 6*d*) in the housing 601. This bias must be overcome before the release sleeve 620 can move axially.

The net pressure force exerted on the release sleeve 620 is close to zero, as the ambient pressure applied through port 602 works on opposite piston areas in the conduit 622. The radial ports 602 through the wall of housing 601 are preferably provided with a filter (not shown) for reasons discussed above.

FIG. 6*b* illustrates an injection state, in which the inner sleeve 610 is displaced to an activated position by the injection pressure applied to an inner piston area 611 (FIG. 6*c*) exposed to the central bore 630 within the string 2. The release sleeve 620 is in the normal operations position as in FIG. 6*a*, and still covers the radial openings 612. The ambient pressure is, as in FIG. 6*a*, applied to the outer piston area 613 through the ports 602 and conduits 622. During normal operation, the force from spring 615 and ambient pressure working on the outer piston area 613 return the inner sleeve to the position shown in FIG. 6*a* after injection, more precisely when the bore pressure in the central bore 630 is lowered to the circulation pressure used when the system 1 moves between injection zones.

Figure 6C:
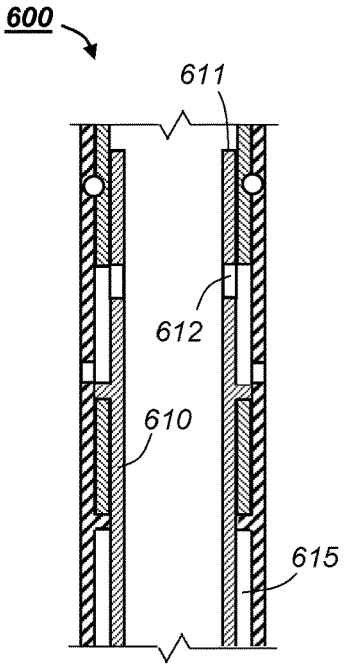

FIG. 6*c* illustrates the state when the bore pressure has reached the intermediate pressure, i.e. a predetermined pressure greater than the injection pressure. In this state, the intermediate pressure exerted on the inner piston area 611 has pushed the inner sleeve 610 against the force from return spring 615 until the radial openings 612 through the inner sleeve 610 align with the conduits 622. The inner sleeve 610 is now in a release position, and the pressure force applied to the inner piston area 611 is reduced by the bore pressure times the outer piston area 613. The inner and outer piston areas (611, 613) and the return spring (615) should be configured such that the vector sum of the return spring force and the net pressure force ensures that the inner sleeve 610 returns to the idle position immediately after it reaches the release position.

Figure 6D:
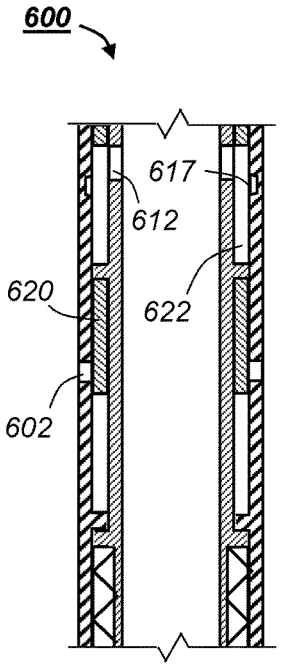

FIG. 6*d* illustrates a release state, in which the return spring 615 has returned the inner sleeve 610 to the idle position shown in FIG. 6*a*. In contrast to the idle state shown in FIG. 6*a*, the release sleeve 620 is displaced to an inactivation position in which the outer piston area 613 is exposed to the bore pressure rather than the ambient pressure. More particularly, the conduits 622 remain aligned with the radial openings 612 in the inner sleeve 610 to provide the inner fluid connection, and the release sleeve 620 covers the radial ports 602 through the wall of the housing 601 to close the outer fluid connection. In the release state illustrated in FIG. 6*d*, the net pressure force on the inner piston area 511 should remain small compared to the spring force from return spring 615, even when the bore pressure increases to the flushing pressure. Thus, at the flushing pressure, the inner sleeve 610 remains in the position shown in FIG. 6*d*, corresponding to the state where the packers 210, 230 are unset or the injection valve 220 is closed.

In FIG. 6*d*, a biased ball 616 attached to the release sleeve 620 has shifted axially with respect to complementary grooves 617 in the housing 601. The axial force required to shift the release sleeve 620 depends on the bias, which may be configured by selecting a suitable spring stiffness and providing a desired pre-compression for a spring radially biasing the ball 616. The biased or spring loaded ball 616 in the present example may be replaced with any with any other known retainer 616.

Returning to FIG. 5, it is understood that the ribs 623 reduce the outer piston area 613 exposed to the conduits 612, whereas the inner piston area 611 may cover the annulus from the inner diameter of sleeve 610 to the inner wall of housing 601. Accordingly, there is a difference between the inner piston area 611 and the outer piston area 613. This corresponds to the net piston area 511 described with reference to FIGS. 3 and 4. In addition, the net piston area exposed to the bore pressure in FIGS. 6*c* and 6*d* can conveniently be adjusted by adjusting the outer piston area 613, i.e. the width in the circumferential direction of the tongues traveling in the conduits 622. This net piston area timed the flushing pressure works against the spring force from the return spring 615. The resulting force should still ensure that a packer or sliding sleeve valve returns to its run-in state, i.e. that the inner sleeve 610 returns to its idle position.

The bore pressure, as the term is used herein an in the claims, is measured relative to the local pressure around the various housings 501, 601 described above. Hence, the net pressure force directed against the force from the return springs 501, 615 equals the bore pressure times the net piston area.

While the invention has been explained by means of examples, many variations and modifications will be obvious to one skilled in the art. The invention is defined by the accompanying claims.

The invention claimed is:

1. A system for stimulating a well with an annulus formed by a string and a wellbore, wherein the system comprises:
- a pressure activated injection assembly configured to open when a bore pressure is at an activation pressure and a bottom valve is closed, the activation pressure being less than below an injection pressure, the pressure activate injection assembly configured to create fractures within a target zone at a first layer;
- a packer pair configured to set across the annulus at the activation pressure to isolate the pressure activated injection assembly;
- a sand control assembly configured to flush the annulus after injection;
- a pressure activated flushing device mounted uphole from the injection assembly at a second layer, and the pressure activated flushing device is configured to open radial flush ports between the interior of string and the annulus when the bore pressure is at a flushing pressure, the flushing pressure being greater than the injection pressure, wherein the first layer and second layers are associated with different types of rock, wherein the pressure activated flushing device does not open the radial flush ports when the bore pressure is at the activation pressure, and the packer pair is configured to unset when the pressure activated flushing device is closed and the pressure activated injection assembly is configured to close when the pressure activated flushing device is closed.

2. The system according to claim 1, wherein the pressure activated flushing device includes:
- a burst disc designed to rupture at the flushing pressure.

3. The system according to claim 1, wherein the pressure activated flushing device includes:
- a sliding sleeve with a net piston area configured to shift the sliding sleeve past radial ports in an associated valve when exposed to the flushing pressure.

4. The system according to claim 3, wherein the sliding sleeve is initially retained by a shear element, the shearing element being configured to break when the net piston area is exposed to the flushing pressure.

5. The system according to claim 3, further comprising:
- a spring configured to oppose the bore pressure force exerted on the net piston area, wherein when the sliding sleeve is displaced the spring is configured to expose the radially directed ports, and provide a spring force equal to the flushing pressure times the net piston area.

6. The system according to claim 1, wherein the flushing device comprises:
- a nozzle directed axially or tangentially relative to the string.

7. The system according to claim 1, further comprising:
- a release mechanism configured to release the injection assembly at an intermediate pressure between the injection pressure and the flushing pressure.

8. A system for stimulating a well with an annulus formed by a string and a wellbore, wherein the system comprises:
- a pressure activated injection assembly configured to open when a bore pressure is at an activation pressure, the activation pressure being less than below an injection pressure, the pressure activate injection assembly configured to create fractures within a target zone at a first layer;
- a sand control assembly configured to flush the annulus after injection;
- a pressure activated flushing device mounted uphole from the injection assembly at a second layer, and the pressure activated flushing device is configured to open radial flush ports between the interior of string and the annulus when the bore pressure is at a flushing pressure, the flushing pressure being greater than the injection pressure, wherein the first layer and second layers are associated with different types of rock, a release mechanism configured to release the injection assembly at an intermediate pressure between the injection pressure and the flushing pressure, wherein the
- release mechanism comprises an inner sleeve with an inner piston area exposed to a central bore, a radial release opening and an outer piston area;
- a return spring opposing a pressure force exerted on the inner piston area;
- a release sleeve arranged between a fixed housing and the inner sleeve; wherein the inner sleeve is axially movable between an idle position and a release position in which the radial release opening opens an inner fluid connection from the central bore to the outer piston area;
- the release sleeve is axially movable between a normal operations position in which the release sleeve closes the inner fluid connection and opens an outer fluid connection from the exterior of the housing to the outer piston area and an inactivation position in which the release sleeve closes the outer fluid connection and opens the inner fluid connection; and wherein the release mechanism is configured such that the inner sleeve reaches the release position when the intermediate pressure is exerted on the inner piston area, and such that the release sleeve shifts from the normal operations position to the inactivation position when the inner sleeve shifts from the release position to the idle position.

9. The system according to claim 8, wherein the release mechanism is configured to return an isolation packer to an unset run-in state when the inner sleeve returns to the idle position.

10. The system according to claim 8, wherein the release mechanism is configured to return a sliding sleeve injection valve to a closed run-in state when the inner sleeve returns to the idle position.

11. The system according to claim 10, wherein the inner sleeve has an active position range corresponding to bore pressures ranging from the activation pressure to the injection pressure.

12. The system according to claim 11, wherein the release sleeve is retained in the normal operation position within the fixed housing by a retainer.

13. The system according to claim 12, wherein the outer piston area is configured to move axially in a longitudinal conduit through a cylindrical wall of the release sleeve.

14. The system according to claim 13, wherein the longitudinal conduit has an end that aligns with the release opening when the inner sleeve is in the release position.

* * * * *